US010995578B2

(12) United States Patent
Shampine

(10) Patent No.: US 10,995,578 B2
(45) Date of Patent: May 4, 2021

(54) SHEARABLE DEPLOYMENT BAR WITH BALLISTIC TRANSFER

(71) Applicant: SCHLUMBERGER TECHNOLOGY CORPORATION, Sugar Land, TX (US)

(72) Inventor: Rod William Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/769,817

(22) PCT Filed: Oct. 20, 2016

(86) PCT No.: PCT/US2016/057785
§ 371 (c)(1),
(2) Date: Apr. 20, 2018

(87) PCT Pub. No.: WO2017/070267
PCT Pub. Date: Apr. 27, 2017

(65) Prior Publication Data

US 2019/0145216 A1 May 16, 2019

Related U.S. Application Data

(60) Provisional application No. 62/244,489, filed on Oct. 21, 2015.

(51) Int. Cl.
*E21B 33/06* (2006.01)
*E21B 43/11* (2006.01)
(Continued)

(52) U.S. Cl.
CPC ..... *E21B 33/068* (2013.01); *E21B 43/1185* (2013.01); *F42D 3/00* (2013.01)

(58) Field of Classification Search
CPC .... E21B 33/068; E21B 43/1185; E21B 43/11; F42D 3/00
See application file for complete search history.

(56) References Cited

U.S. PATENT DOCUMENTS 3,238,873 A * 3/1966 Allen ..... F42D 1/04 102/275.3
3,238,876 A * 3/1966 Allen ..... F42D 1/04 102/275.4

(Continued)

FOREIGN PATENT DOCUMENTS

WO 2012037248 A2 3/2012

OTHER PUBLICATIONS

West Engineering Services, Shear Ram Capabilities Study, Sep. 2004.*

(Continued)

*Primary Examiner* — Aaron L Lembo
(74) *Attorney, Agent, or Firm* — Rodney Warfford

(57) ABSTRACT

Apparatus includes a conveyance device and a first shearable deployment bar connected to the conveyance device at a first distal end of the first shearable deployment bar, where the first shearable deployment bar has a deployment bar section and a shearable section. The shearable deployment bar is configured to carry a ballistic signal from an initiating charge, through the shearable deployment bar, and to a donor charge. The apparatus further includes a first set of perforating guns connected to the first shearable deployment bar at a second distal end thereof, and the first set of perforating guns are configured to receive the ballistic signal from the donor charge to ultimately fire the perforating guns at a targeted location in a wellbore. A second shearable deployment bar may be connected to the first set of perfo- (Continued)

rating guns, and a second set of perforating guns connected to the second shearable deployment bar.

21 Claims, 6 Drawing Sheets

(51) Int. Cl.

| | |
|---|---|
| ***F42D 3/00*** | (2006.01) |
| ***E21B 33/068*** | (2006.01) |
| ***E21B 43/1185*** | (2006.01) |

(56) References Cited

U.S. PATENT DOCUMENTS

| | | | | | |
|---|---|---|---|---|---|
| 3,945,322 | A | * | 3/1976 | Carlson | F42D 1/04 102/275.4 |
| 4,660,472 | A | * | 4/1987 | Stevens | F42C 15/34 102/202.1 |
| 4,759,291 | A | * | 7/1988 | Barker | E21B 43/116 102/202.5 |
| 4,829,765 | A | * | 5/1989 | Bolieau | F02K 9/26 60/250 |
| 4,850,438 | A | | 7/1989 | Regalbuto | |
| 5,099,761 | A | * | 3/1992 | Betts | F42B 3/113 102/201 |
| 5,113,763 | A | * | 5/1992 | Schoeyer | F42C 19/0819 102/202 |
| 5,179,246 | A | * | 1/1993 | Betts | F42B 3/113 102/201 |
| 5,470,118 | A | | 11/1995 | Burton | |
| 5,603,379 | A | | 2/1997 | Henke et al. | |
| 5,959,236 | A | * | 9/1999 | Smith | F42C 19/0815 102/200 |
| 6,155,344 | A | | 12/2000 | Myers, Jr. et al. | |
| 6,591,911 | B1 | | 7/2003 | Markel et al. | |
| 6,672,405 | B2 | | 1/2004 | Tolman et al. | |
| 8,622,149 | B2 | | 1/2014 | Gill et al. | |
| 9,494,021 | B2 | * | 11/2016 | Parks | E21B 43/117 |
| 9,784,549 | B2 | * | 10/2017 | Eitschberger | F42D 1/05 |
| 2016/0319646 | A1 | * | 11/2016 | Escudero | E21B 43/117 |

OTHER PUBLICATIONS

International Search Report and Written Opinion issued in International Patent Application No. PCT/US2016/057785 dated Jan. 6, 2017; 15 pages.

* cited by examiner

SHEARABLE DEPLOYMENT BAR WITH BALLISTIC TRANSFER

RELATED APPLICATION INFORMATION

This application claims the benefit of U.S. Provisional Application No. 62/244,489 filed Oct. 21, 2015, which is incorporated herein in its entirety by reference.

TECHNICAL FIELD

The field to which the disclosure generally relates to wellsite equipment such as oilfield surface equipment such as pressure pumping equipment, mixing equipment and the like, downhole tools and assemblies, coiled tubing (CT) tools and assemblies, slickline tools and assemblies, wireline tools and assemblies, and the like.

BACKGROUND

The statements in this section merely provide background information related to the present disclosure and may not constitute prior art.

Coiled tubing is a technology that has been expanding its range of application since its introduction to the oil industry in the 1960's. Its ability to pass through completion tubulars and the wide array of tools and technologies that can be used in conjunction with it make it a very versatile technology.

Typical coiled tubing apparatus includes surface pumping facilities, a coiled tubing string mounted on a reel, a method to convey the coiled tubing into and out of the wellbore, such as an injector head or the like, and surface control apparatus at the wellhead. Coiled tubing has been utilized for performing well treatment and/or well intervention operations in existing wellbores such as, but not limited to, hydraulic fracturing, matrix acidizing, milling, perforating, coiled tubing drilling, and the like.

In coiled tubing, wireline, and slickline services, downhole tools are transferred from the back of a truck to inside the wellbore. This is commonly done by using a long riser with the conveyance apparatus attached to the top of the riser. In such a method, the tools are either pulled into the bottom of this riser, or are assembled into it. The riser is then attached to the well, pressure tested, and the tools are run into the well after the pressure test.

An alternative method to transfer the wellbore tools to the wellbore is to have an easier to run service place the tools in the well, then have the harder service do the running in hole. In this method, the downhole tools are provided with an additional part, a deployment bar. The deployment bar provides a surface that the blow out preventers (BOPs) of the wellsite pressure control equipment can both grip and seal on. In the case where the harder service is a coiled tubing service, a wireline service or a slickline service may be used to pre-place the tools in the coiled tubing blow out preventers with a deployment bar. In such an embodiment, the deployment bar used will match the coiled tubing diameter. As part of the contingency plans, it must always be possible to close the master valves. In order to do this while the tools are hanging in the blow out preventers, and without opening the well to atmosphere, the deployment bar must be capable of being sheared by the shear ram in the blow out preventer. Once the deployment bar is sheared, the slip and pipe rams may be opened and the tool dropped into the well. This process is identical to that used when coiled tubing must be cut and dropped.

It remains desirable to provide improvements in oilfield surface equipment and/or downhole assemblies such as, but not limited to, methods and/or systems for improvements in surface equipment for coiled tubing deployment methods, systems, and/or equipment.

SUMMARY

In some aspects, the disclosure provides apparatus including a conveyance device, and a first shearable deployment bar connected to the conveyance device at a first distal end of the first shearable deployment bar, where the first shearable deployment bar has a deployment bar section and a shearable section. The shearable deployment bar is configured to carry a ballistic signal from an initiating charge, through the shearable deployment bar, and to a donor charge. The apparatus further includes a first set of perforating guns connected to the first shearable deployment bar at a second distal end thereof, and the first set of perforating guns are configured to receive the ballistic signal from the donor charge to ultimately fire the perforating guns at a targeted location in a wellbore.

In some cases, a second shearable deployment bar is connected to the first set of perforating guns at a first distal end of the second shearable deployment bar, and a second set of perforating guns connected to the second shearable deployment bar at a second distal end thereof. The second shearable deployment bar includes a deployment bar section and a shearable section, and the second shearable deployment bar is configured to carry a second ballistic signal from the first set of perforating guns, to an initiating charge, through the second shearable deployment bar, and to a donor charge. The second set of perforating guns are configured to receive the second ballistic signal from the donor charge.

In some embodiments, the apparatus further includes a cross over section disposed between the deployment bar section and a shearable section. The apparatus, in some cases, may further have a top sub disposed between the deployment bar section and the conveyance device. Some examples of suitable conveyance devices include coiled tubing, slickline and wireline.

In some aspects, the first shearable deployment bar has a bulkhead initiator, a delay tube, and donor charge for receiving and transmitting the ballistic signal, and the shearable section may contain a detonation cord. Detonation cord may be configured in a spiral orientation within the shearable section, to help center the cord therein.

Some embodiments of the disclosure are shearable deployment bars having a deployment bar section and a shearable section, where the shearable deployment bar is configured to carry a ballistic signal from an initiating charge, through the shearable deployment bar, and to a donor charge. In some cases, the shearable deployment bar includes a bulkhead initiator, a delay tube having detonation cord, and a donor charge for receiving and transmitting the ballistic signal to a set of perforating guns.

The shearable deployment bar may be connectably disposed between a coiled tubing, wireline or slickline conveyance device and a set of perforating guns, in some aspects. Further, the shearable deployment bar may be used in system configuration include a plurality of such shearable deployment bars disposed between each of a plurality of sets of perforating guns. In such cases, each of shearable deployment bars transmits the ballistic signal to each set of perforating guns in a time sequential manner.

In some other aspects of the disclosure, methods include providing a first set of perforating guns, then providing a first shearable deployment bar and connecting the first shearable deployment bar to the first set of perforating guns. The first shearable deployment bar includes a deployment bar section and a shearable section, and the shearable deployment bar is configured to carry a ballistic signal from an initiating charge, through the shearable deployment bar, and to a donor charge. The first set of perforating guns is configured to receive the ballistic signal from the donor charge.

The first shearable deployment bar is connected to a conveyance device, and then the first set of perforating guns, the first shearable deployment bar and the conveyance device are introduced into a wellbore. Then, a ballistic signal is initiated at the initiating charge and the perforating guns subsequently fired.

Generally, some embodiments according to the disclosure may be used in methods for performing a wellbore operation with a shearable deployment bar with ballistic transfer as shown and described herein.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION OF SOME ILLUSTRATIVE EMBODIMENTS

Figure 1:
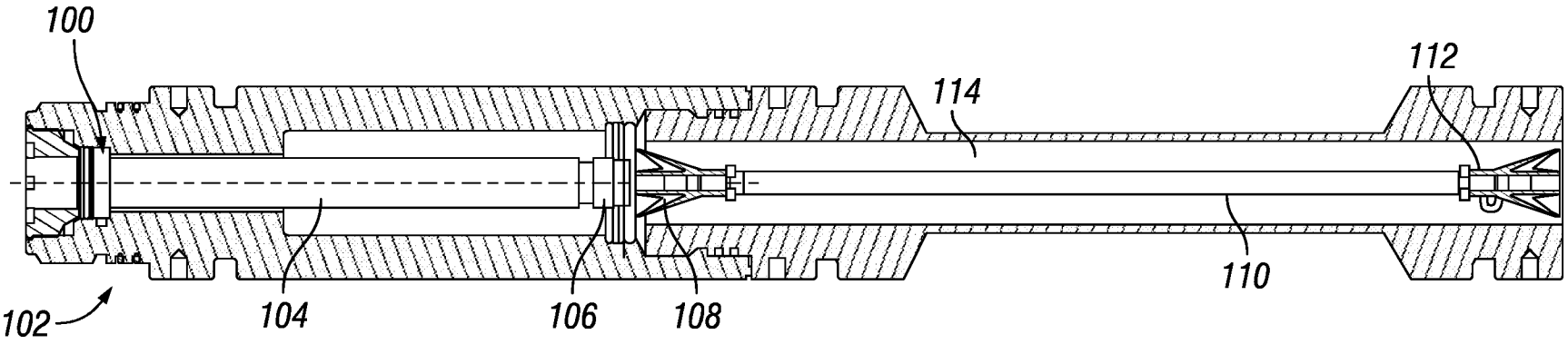
FIG. 1 depicts a shearable deployment bar with ballistic transfer according to an aspect of the disclosure, in a cross-sectional view.

The following description of the variations is merely illustrative in nature and is in no way intended to limit the scope of the disclosure, its application, or uses. The description and examples are presented herein solely for the purpose of illustrating the various embodiments of the disclosure and should not be construed as a limitation to the scope and applicability of the disclosure. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a value range listed or described as being useful, suitable, or the like, is intended that any and every concentration or amount within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possession of the entire range and all points within the range.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Also, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

The present disclosure provides a method of making and/or using a deployment bar that is designed to maximize its ability to be sheared while also providing a ballistic path that is pressure tight before and after firing. An embodiment of such a ballistic path may be found in commonly assigned U.S. Pat. No. 8,622,149, the disclosure of which is hereby incorporated by reference herein in its entirety.

In the present disclosure, embodiments of deployment bars are designed such that the deployment bar may be sheared by standard coiled tubing BOP(s). This bar is also provided with one or more through bulkhead initiator(s), such as, but not limited to, a deflagration time delay device, detonating cord, and a booster charge to couple the detonation wave to the gun below the bar.

There is shown in FIG. 1 an embodiment of a shearable deployment bar with ballistic transfer according to an aspect of the disclosure, in a cross-sectional view. A pressure tight seal and through bulkhead initiator is indicated at reference numeral 100. A connection 102 is configured to engage with a first perforating gun (not shown). An optional pyrotechnic delay tube 104 extends between the initiator 100 and a transfer device 106 for transferring the deflagration of the delay to a detonation wave to trigger the receptor 108. The receptor 108 triggers a detonation cord 110, which in turn triggers the transfer or donor charge 112 that initiates the next, second, perforating gun (not shown). The shearable section of the deployment bar is indicated generally at 114. Additionally, the connection 102 of the deployment bar may be provided with suitable features to make fishing easier after shearing.

Figure 2:
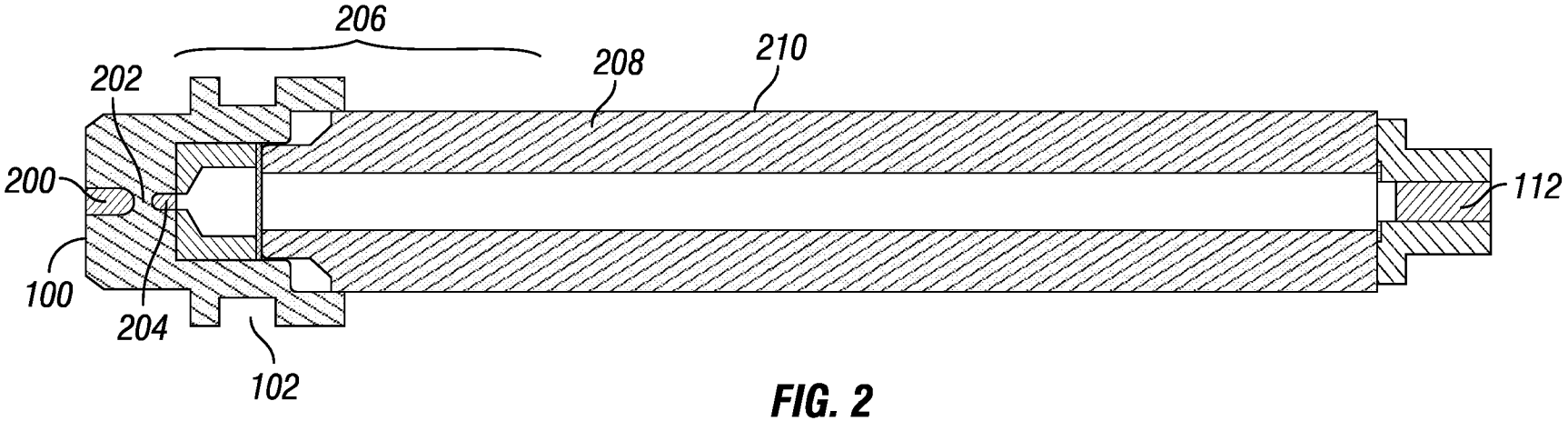
FIG. 2 illustrates a shearable deployment bar including a bulkhead initiator, a delay tube, and a donor charge 112, in a simplified view to illustrate the inner components of the perforating gun detonation system, according to the disclosure.

There is shown in FIG. 2 a cross-sectional view of the through bulkhead initiator 100, the delay tube 102, and donor charge 112, in a simplified view to illustrate the inner components of the perforating gun detonation system. A solid metal barrier 202 is shown disposed between the initiating charge 200 in the initiator section 100, and a transfer charge 204 at the connection 102 of the deployment bar 206.

The through bulkhead initiator 100 is pressure tight before and after detonation, resulting in a deployment bar 206 that is functionally equivalent to a wired deployment bar, but which passes a ballistic signal from the initiating charge 200, through the deployment bar 206 and ultimately to the donor charge 112. A pyrotechnic delay 208 is provided through the charge transfer through the shearable section 210 of deployment bar 206.

Figure 3A:
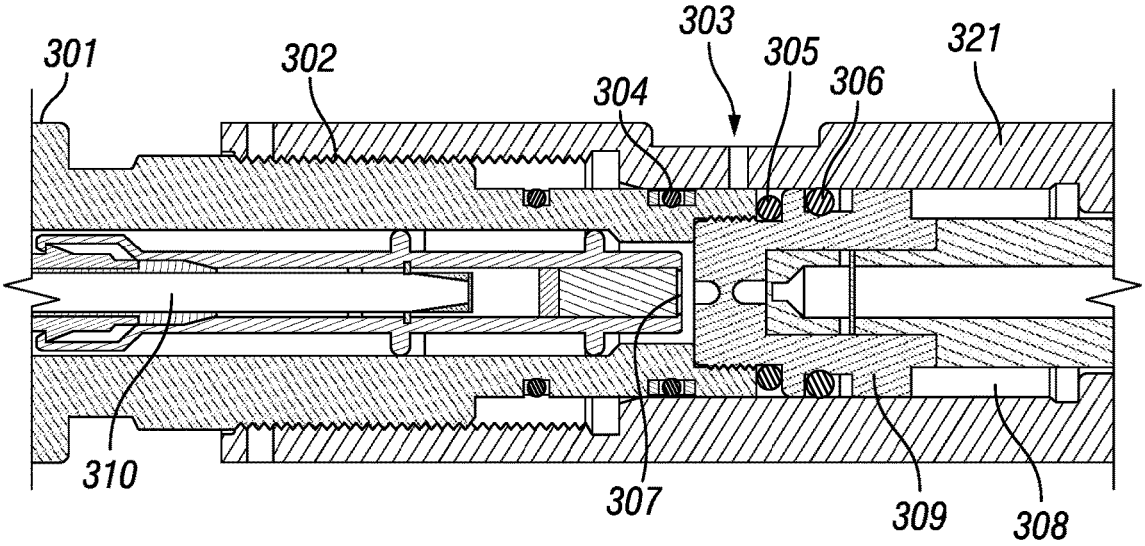
FIG. 3A shows pressure testing port provided for pre-testing the seal(s) on the ballistic transfer in a cross-sectional view, according to the disclosure.
Figure 3B:
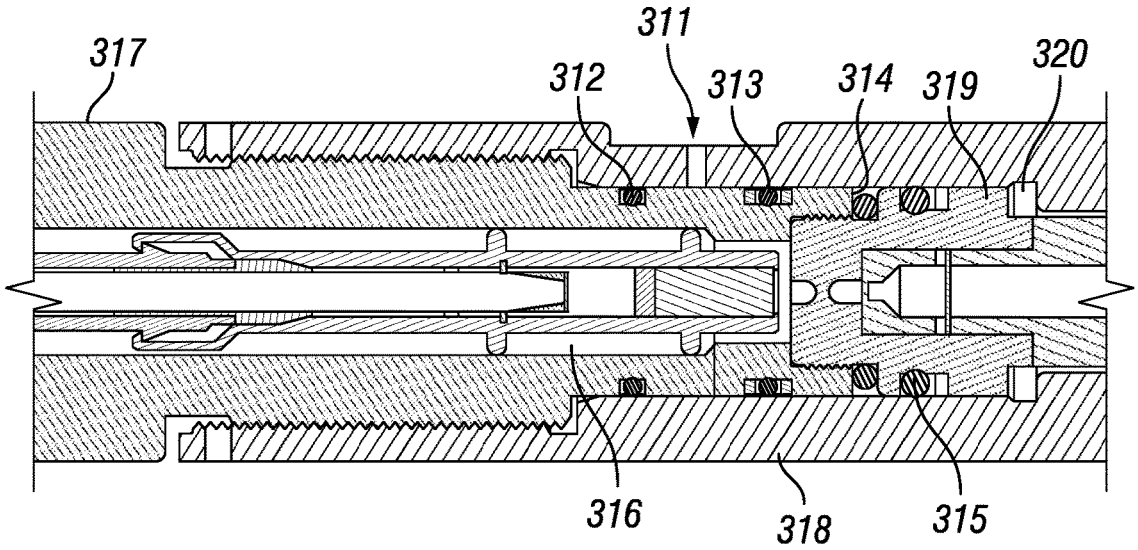
FIG. 3B shows pressure testing port provided for pre-testing the seal(s) on the ballistic transfer in a cross-sectional view, according to the disclosure.

In some aspects of the disclosure, a facility is provided to pre-test one or more seals on the deployment bar. Said seals are preferably those that, in combination with the BOP sealing rams, prevent wellbore pressure from passing through the deployment bar. In FIGS. 3A and 3B, such an arrangement is disclosed. FIG. 3B shows the assembly ready to run in hole while FIG. 3A shows the first stage of testing. In FIG. 3A, the section of the tool 301 that provides the BOP ram sealing surface has the lower section 321 partially screwed onto thread system 302. In this state testing port 303 is located between upper o-ring 304, the radial seal 305, and the ballistic transfer seal 306. When test pressure is applied, seal 306, 305, and 304 are tested. Seal 305 is tested in the direction it will be used in both the deployment process and the reverse deployment process. Before the guns are fired following placement of the deployment bar downhole, and post-testing, chamber 307 and 308 are at atmospheric pressure. During the firing process chamber 307 is flooded by the guns above it firing through the gun tubes. At this point, seal 306 prevents wellbore pressure from entering chamber 308 while the bulkhead and delay module 309 is delaying, and is pressurized in the direction of pre-testing. After the delay, the gun below the lower section 321 is flooded by the guns firing.

After testing, the lower section 321 (318 in FIG. 3B) is fully screwed onto thread system 302 of the deployment bar 301 (317 in FIG. 3B), causing testing port 303 (311 in FIG. 3B) to cross O-ring 304 (313 in FIG. 3B). This state is shown as FIG. 3B. In this state pressure is applied to testing port 311, pressurizing O-ring 312 and 313. This test engages seal 313 in the direction that it will see pressure during both deployment and reverse deployment. A plug may be installed in port 311 after testing to prevent debris ingression if desired. After performing both of these tests, the tool may be run in the well. During deployment, the critical leak path to the inside bore 316 of the deployment bar is sealed by O-rings 313 and 314, both of which have been pre-tested in the correct direction. During reverse deployment (after firing perforating guns), wellbore pressure is applied to both the OD of the tool and the bore 320 of the lower sub. Seals 313 and 315 are the first barrier, followed by seal 314. Seals 313 and 314 have both been pre-tested to hold pressure in the direction that is applied here. Seal 315 has been tested in the reverse direction, but its sealing ability has also been pre-tested. A second ballistic transfer 319 may be applied below this system and similarly provided with a pre-testing system if a second bulkhead barrier is desired. The pre-testing operation above is particularly advantageous because applying a test pressure in excess of wellbore pressure on the outside of perforating guns is not permitted, and pre-testing removes some aspects of the need to do this. Other aspects of this need are commonly addressed with quick test subs that allow the integrity of a riser joint to be tested without pressurizing the ID of the riser.

In an embodiment, the deployment bar may be configured to flood its interior early in the shearing process, for example, to reduce explosion hazards. The interior of the deployment bar may incorporate elements to reduce the hazard of detonation cord ignition during shearing, such as, but not limited to, sleeving material (lead, plastic, ceramic, and other metals), filling materials (such as fluids and finely divided solids (such as sand and ceramic particles). The deployment bars according to the disclosure may incorporate a mechanism to pre-shear the detonating cord and pull the detonating cord downward before the detonating cord is contacted by the coiled tubing BOP shearing blades. The deployment bar according to the disclosure may incorporate an internal design in the bar such that the detonation cord is separated at a predetermined location such that its likelihood of initiating an explosion during separation is minimized. The deployment bar according to the disclosure may incorporate internal features that are designed to interact with the detonating cord during shearing and thereby separate the cord with a minimum explosion hazard.

In an embodiment, two through bulkhead initiators may be incorporated with one above and one below the bar arranged such that in the event of detonating cord being exploded during shearing that a time delay is provided on the lower end allowing guns to be dropped into the well and sufficiently deep that accidental detonation does not result in loss of well control.

Figure 4:
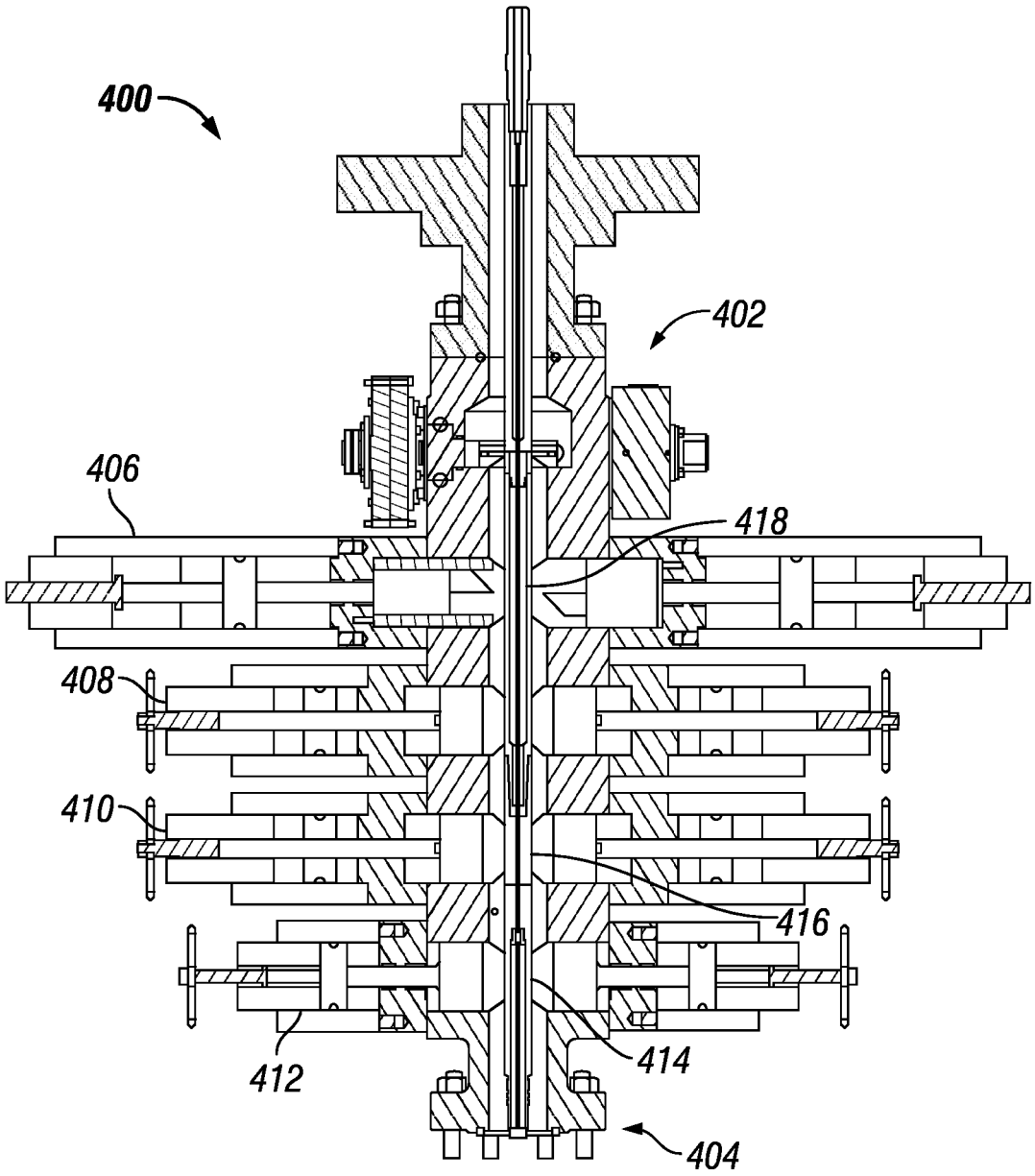
FIG. 4 depicts one aspect of a shearable deployment bar disposed in a wellhead blow out preventer in a cross-sectional view, in accordance with the disclosure; and, FIGS. 5 and 6 illustrate another shearable deployment bar embodiment according to the disclosure, in a perspective and cross-sectional view, respectively.

Now referencing FIG. 4, which depicts one aspect of a shearable deployment bar disposed in a wellhead blow out preventer (BOP), in a cross-sectional view. Blow out preventer 400 includes an upper end 402, which is connectable with a riser for introducing tools into the wellbore, and lower end 404 which is sealed with a wellbore casing. Blow out preventer 400 also includes rams 406, 408, 410 and 412, which may be used to seal the wellbore in some aspects, or shear the tool in case unexpected shutting and isolation of the wellbore from the ambient environment becomes necessary, such as the case with shearing ram 406. The shearable deployment bar is disposed within blow out preventer 400, and includes such components as shearable section 414, optional cross-over section 416, and deployment section 418. Upper end of deployment section 418 has a connection configured to engage with a first perforating gun and deployment section 418 may further include, or be connected with, a pyrotechnic delay tube extending between an initiator and a transfer device for transferring deflagration of the delay to a detonation wave to trigger a receptor disposed in an upper portion of shearable section 414. The receptor triggers a detonation cord extending through shearable section 414, which in turn triggers the transfer or donor charge that initiates the next, second, perforating gun (not shown), which may be connected to a lower end of shearable section 414. In such way, a delayed and controlled initiation of a perforation gun, or set of guns, may be executed when the tool is situated at a targeted location in the wellbore.

In some aspects of the disclosure, it is advantageous to locate the detonation delay below the shear plane of the blow out preventer. In such cases, in the event that the detonation cord is unexpectedly triggered, the blow out preventer pipe/slip rams may be opened, the shear ram closed, and the tool string dropped into the wellbore before perforation gun detonation. Also, in accordance with the disclosure, the detonation cord is selected and incorporated so does not explode when sheared with the blow out preventer shearing ram blades. Further, using a short and thinner wall in the shearable section is effective in some cases, where it is possible to precisely locate the shearable section in the blow out preventer, since the short section acts stronger than a long section due to the end support. In some aspects, it is possible to select precisely where to shear the shearable section.

Figure 5:
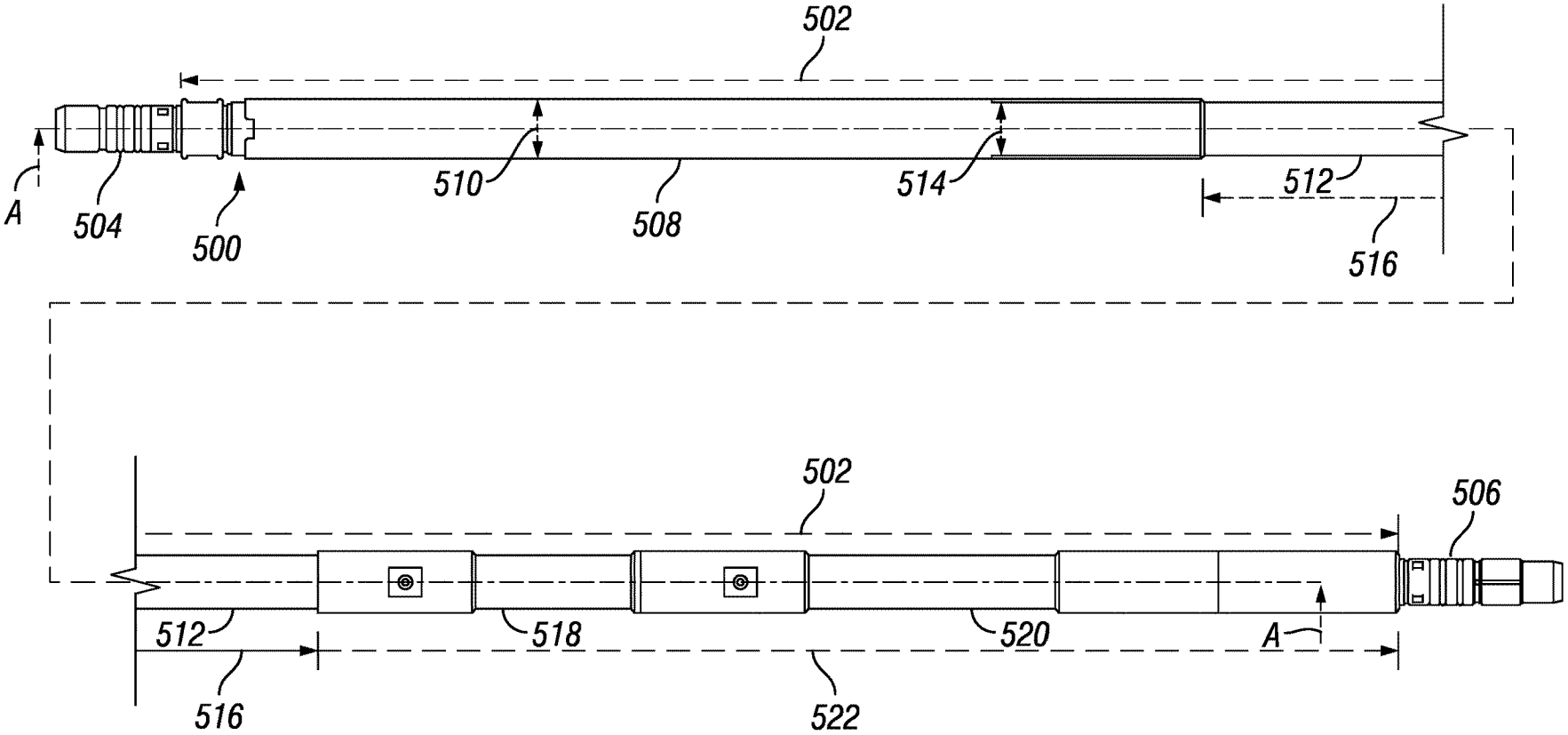
Figure 6:
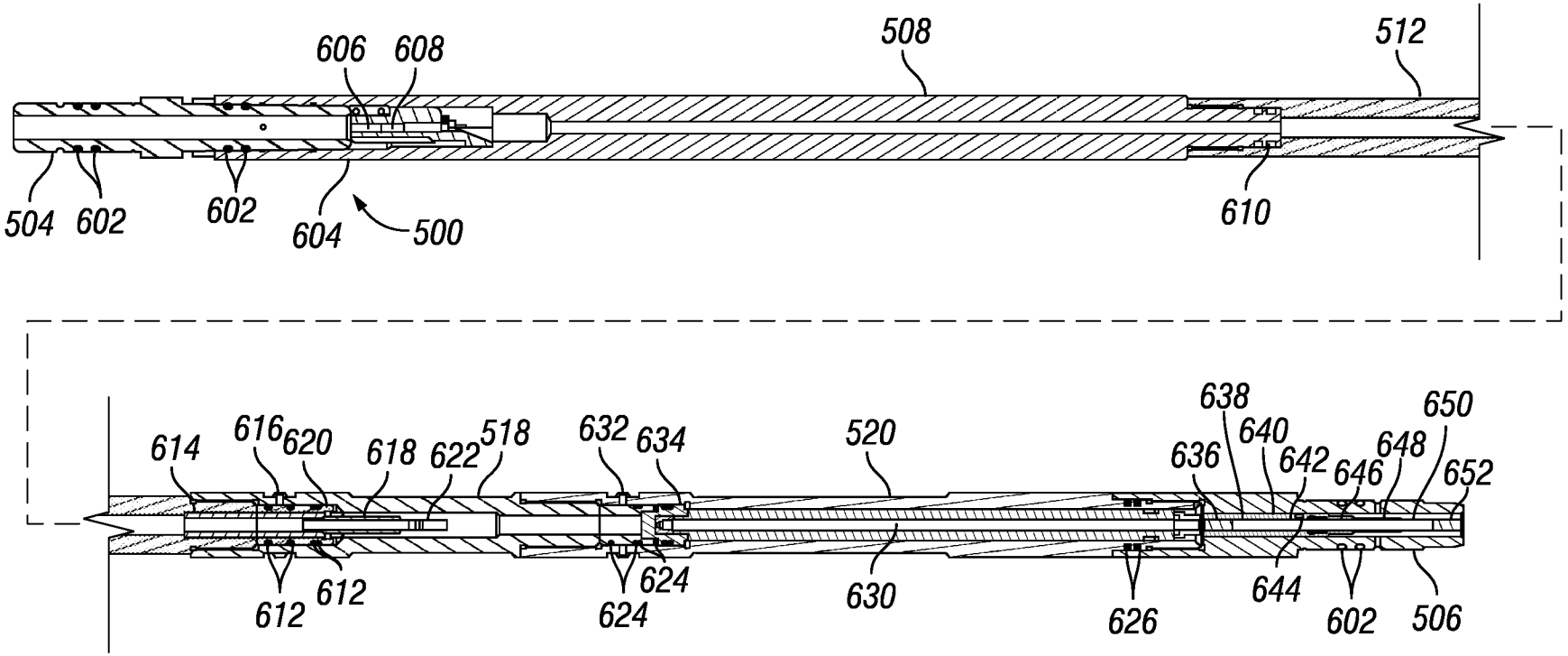

FIGS. 5 and 6 together illustrate another shearable deployment bar embodiment according to the disclosure, in a perspective and cross-sectional view, respectively. As shown in FIG. 5, shearable deployment bar 500 has an overall make up length 502 which is less than about 3 meters, or even less than or about 2 meters, not including distal ends of connectors 504 and 506. Shearable deployment bar 500 includes top sub 508, which may have any suitable diameter 510, such as, but not limited to, about 4.5 cm or less, or even about 4.3 cm or less. Shearable deployment bar 500 further includes deployment bar section 512 having any suitable diameter 514, such as about 4.0 cm or less, or even about 3.8 cm or less. The length 516 of deployment bar section 512 is not particularly limited to any values, but in some aspects the length 516 may be about 60 cm or less, or even about 51 cm or less. Shearable deployment bar 500 also includes cross over section 518 and shearable section 520, which together have a length 522 that may be about one meter or less, and in some cases, 76 cm or less.

FIG. 6 depicts shearable deployment bar 500 in a cross-sectional view taken at plane 'A' in FIG. 5. Distal connections 504 and 506 include o-rings 602 disposed on the outer periphery thereof. Top sub 508 includes such features as shell crimp section 604 for sealingly attached with connector 504, booster 606, booster shim 608, and o-rings 610 for sealingly engaging deployment bar section 512, which includes o-rings 612 for sealingly engaging cross over section 518. Cross over section 518 includes such features as shock absorber 614, screw 616 for securing sealingly engaging cross over section 518 with deployment bar section 512, triggering mechanism 618 retained by screw 620, shell 622 for detonation, and o-rings 624 for sealingly engaging shearable section 520.

Shearable section 520 includes such components as o-rings 626 for sealingly engaging connector 506, screw-cap 628 for securing detonation cord 630 within shearable section 520, screw 632 for securing with cross over section 518, and ballistic time delay fuse 634 which controls the time delay for energizing detonation cord 630. Extending from shearable section 520 are booster 636, booster shim 638, receptor housing 640, shell 642, C-lock retainer 644, ring lock 646, shell 648, booster shim 650 and booster 652.

In some aspects of the disclosure, the material(s) used in forming the sheared portion of the shearable section have less than or equal to about 80,000 psi yield and is compatible with hydrogen sulfide when present in a wellbore, to avoid embrittlement. In an aspect, at about 80,000 psi yield, a shearable section is formed of steel with an outer diameter of about 3.81 cm, a wall thickness of about 1.78 cm, and an inner bore diameter of about 0.26 cm. In another aspect, a shearable section is formed of steel with an outer diameter of about 4.45 cm, and a wall thickness of about 1.07 cm. In yet other aspects, shearable sections are formed of steel with an outer diameter of about 5.08 cm, and a wall thickness of about 0.86 cm in one case, while in another case, an outer diameter of about 6.03 cm, and a wall thickness of about 0.67 cm. Hence, to maintain a target yield point, larger outer diameter shearable sections have a thinner wall than smaller outer diameter shearable sections.

With regards to explosion resistance, in accordance with the disclosure, three factors are considered: (1) wall thickness; (2) air volume versus detonation cord volume; and (3) detonation cord standoff. In cases where wall thickness of the shearable section is significant (i.e. greater than about 1 cm) it is very resistant to swelling/exploding. However, as the inner bore diameter is reduced, the pressure produced by the gasses from the explosion increases. Also, for inner bore diameters the detonation cord is disposed nearer the inner wall surface, which then can result in blast wave abuse of the inner wall surface. Therefore, there is an optimum balance for a shear section outer diameter where these factors cross. As such, there are points or a range of points where the shearable section wall will either swell slightly and acceptably, or not swell at all. In some aspects, for typical detonation cord, a shearable section wall with a thickness of about 0.32 cm to about 0.48 cm, or even from about 0.37 to about 0.43 cm is optimum. In some aspects, a detonation cord is of a spiral cord design in order to center the detonation cord in the inner bore, and more uniformly distribute the forces generated throughout the shearable section.

In some aspects of the disclosure, the external pressure rating of the shearable section is higher than surface test pressure and downhole pressure. Two limiting factors may be considered in such cases, such as yield of the wall and potential for buckling. In some embodiments, according to these factors a shearable section may have an outer diameter of from about 3.8 cm to about 4.4 cm with a wall thickness of about 0.32 cm to about 0.65 cm, and in some cases a wall thickness of about 0.63 cm.

Shearable deployment bars according to the disclosure are deployed into the wellbore with perforating guns, which include gun carriers and shaped charges mounted on or in the gun carriers. The perforating guns are attached to the shearable deployment bars and lowered through the wellbore to the desired well interval. The gun carriers generally are retrievable carriers, designed to remain substantially intact so that they can be retrieved to the surface. An example of a retrievable gun carrier is a strip on which capsule charges are mounted and which is retrieved after perforating. In some aspects, multiple gun carriers are deployed with shearable deployment bars connected at the upper end of each of the gun carriers, and the shearable deployment bars serve a function of triggering guns on each of the gun carriers in a targeted sequential order. While any suitable number of gun carriers and shearable deployment bars may be used in an operation, in some aspects, up to ten sets of shearable deployment bars/gun carriers are used. Also, while there is no limit to the number of guns disposed on each carrier, in some cases, up to ten guns are mounted on each of the gun carriers. Nonlimiting examples of gun carriers useful in accordance with some aspects of the disclosure are provided in U.S. Pat. Nos. 6,591,911B1 and 6,672,405B2, the disclosures of which are incorporated herein by reference thereto.

In some aspects, shearable deployment bars according to the disclosure may be used in spooled conveyance services using such conveyance devices as coiled tubing, wireline, and slickline, where the downhole tools need to be transferred from the reel to inside the well bore. This transfer is conventionally accomplished using a long riser with the conveyance attached to the top of the long riser. In such methods, the tools are either pulled into the bottom of this riser, or are assembled into it. The riser is then attached to the well, is pressure tested, and then the tools are run into the well. In an aspect of the disclosure, an 'easier to run' service is utilized to place the perforation tools in the well using the shearable deployment bar; hence, shorter tool component lengths are possible, thus obviating the need for heavy and large risers.

The deployment bar aspect of the shearable deployment bar is intended to provide a surface against which the blow out preventers can both grip and seal. The deployment bar used will be selected to have a diameter substantially equal to coiled tubing diameter. As part of the contingency plans, it must always be possible to close the master valve of the blow out preventer. In order to do this while the downhole tools are hanging in the blow out preventer, and without opening the well to atmosphere (thereby creating a blow-out), the deployment bar must be capable of being sheared by the shear ram in the blow out preventer. Once this is done, the slip and pipe rams can be opened and the tool dropped into the well.

The foregoing description of the embodiments has been provided for purposes of illustration and description. Example embodiments are provided so that this disclosure will be sufficiently thorough, and will convey the scope to those who are skilled in the art. Numerous specific details are set forth such as examples of specific components, devices, and methods, to provide a thorough understanding of embodiments of the disclosure, but are not intended to be exhaustive or to limit the disclosure. It will be appreciated that it is within the scope of the disclosure that individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Also, in some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. An apparatus comprising:

a conveyance device;

a first shearable deployment bar connected to the conveyance device at a first distal end of the first shearable deployment bar, wherein the first shearable deployment bar comprises a deployment bar section and a shearable section, and wherein the shearable deployment bar is configured to carry a ballistic signal from an initiating charge, through the shearable deployment bar, and to a donor charge via, at least in part, a detonation cord extending through the shearable section in a manner enabling shearing of the detonation cord when shearing the shearable section; and a first set of perforating guns connected to the first shearable deployment bar at a second distal end thereof, wherein the first set of perforating guns are configured to receive the ballistic signal from the donor charge.

2. The apparatus of claim 1 further comprising a second shearable deployment bar connected to the first set of perforating guns at a first distal end of the second shearable deployment bar, and a second set of perforating guns connected to the second shearable deployment bar at a second distal end thereof.

3. The apparatus of claim 2, wherein the second shearable deployment bar comprises a deployment bar section and a shearable section, and wherein the second shearable deployment bar is configured to carry a second ballistic signal from the first set of perforating guns, to an initiating charge, through the second shearable deployment bar, and to a donor charge, and wherein the second set of perforating guns are configured to receive the second ballistic signal from the donor charge.

4. The apparatus of claim 1 further comprising a cross over section disposed between the deployment bar section and a shearable section.

5. The apparatus of claim 1 further comprising a top sub disposed between the deployment bar section and the conveyance device.

6. The apparatus of claim 1, wherein the conveyance device is selected from coiled tubing, slickline or wireline.

7. The apparatus of claim 1, wherein the first shearable deployment bar comprises a bulkhead initiator, a delay tube, and donor charge for receiving and transmitting the ballistic signal.

8. The apparatus of claim 1, wherein the detonation cord is configured in a spiral orientation within the shearable section.

9. The apparatus of claim 1, wherein the first set of perforating guns comprises a gun carrier and a plurality of shaped charges.

10. A shearable deployment bar comprising a deployment bar section, a shearable section, and a detonation cord extending through the shearable section, wherein the shearable deployment bar is configured to carry a ballistic signal from an initiating charge, through the shearable deployment bar, and to a donor charge, the shearable deployment bar further comprising a pyrotechnic delay tube to facilitate a pyrotechnic delay, the detonation cord being located such that the detonation cord is sheared when the shearable deployment bar is sheared.

11. The shearable deployment bar of claim 10 which comprises a bulkhead initiator to initiate the initiating charge.

12. The shearable deployment bar of claim 10 as connectably disposed between a coiled tubing conveyance device and a set of perforating guns.

13. The shearable deployment bar of claim 10 as connectably disposed between a wireline conveyance device and a set of perforating guns.

14. The shearable deployment bar of claim 10 comprising a plurality of additional shearable deployment bars disposed between corresponding sets of perforating guns.

15. The shearable deployment bar of claim 14, wherein each of the shearable deployment bars transmits the ballistic signal to each set of perforating guns in a sequential manner.

16. The shearable deployment bar of claim 10, wherein a shearing ram is disposed in a blowout preventor and oriented to shear the shearable section.

17. The shearable deployment bar of claim 10, wherein the shearable section is formed of a material having less than or equal to 80,000 psi yield.

18. A method comprising:

providing a first set of perforating guns;

providing a first shearable deployment bar and connecting the first shearable deployment bar to the first set of perforating guns, wherein the first shearable deployment bar comprises a deployment bar section, a shearable section, and a detonation cord extending through the shearable section at a location facilitating shearing of the detonation cord when shearing the first shearable deployment bar, wherein the shearable deployment bar is configured to carry a ballistic signal from an initiating charge, through the shearable deployment bar, and to a donor charge, and wherein the first set of perforating guns is configured to receive the ballistic signal from the donor charge;

connecting the first shearable deployment bar to a conveyance device; and, introducing the first set of perforating guns, the first shearable deployment bar and the conveyance device into a wellbore.

19. The method of claim 18 further comprising initiating a ballistic signal at the initiating charge and subsequently firing the perforating guns.

20. The apparatus of claim 1 wherein the deployment bar comprises seals that restrict wellbore pressure from passing through and the seals are disposed such that the seals can be pre-tested before the deployment bar is placed within a BOP.

21. The apparatus of claim 1 wherein the deployment bar comprises a connection positioned to facilitate fishing of the shearable section.

* * * * *